US007938999B2

(12) United States Patent
Iwata et al.

(10) Patent No.: US 7,938,999 B2
(45) Date of Patent: May 10, 2011

(54) HIGH-STRENGTH FIBER OF BIODEGRADABLE ALIPHATIC POLYESTER AND PROCESS FOR PRODUCING THE SAME

(75) Inventors: Tadahisa Iwata, Wako (JP); Toshihisa Tanaka, Wako (JP); Yoshiharu Doi, Wako (JP)

(73) Assignee: Riken, Saitama (JP)

( * ) Notice: Subject to any disclaimer, the term of this patent is extended or adjusted under 35 U.S.C. 154(b) by 183 days.

(21) Appl. No.: 11/664,285

(22) PCT Filed: Aug. 4, 2005

(86) PCT No.: PCT/JP2005/014307

§ 371 (c)(1),
(2), (4) Date: Mar. 30, 2007

(87) PCT Pub. No.: WO2006/038373

PCT Pub. Date: Apr. 13, 2006

(65) Prior Publication Data

US 2008/0061467 A1 Mar. 13, 2008

(30) Foreign Application Priority Data

Oct. 1, 2004 (JP) ..... 2004-290442

(51) Int. Cl.
*B29C 47/06* (2006.01)

(52) U.S. Cl. ..... 264/173.12; 264/210.5; 264/172.11; 264/172.16; 264/172.17; 264/178 R; 442/334

(58) Field of Classification Search ..... 264/210.5, 264/172.11, 172.16, 172.17, 173.12, 178 R; 442/334

See application file for complete search history.

(56) References Cited

U.S. PATENT DOCUMENTS 4,537,738 A 8/1985 Holmes
6,645,622 B2 * 11/2003 Yamane ..... 428/364

(Continued)

FOREIGN PATENT DOCUMENTS

EP 0 104 731 A2 4/1984

(Continued)

OTHER PUBLICATIONS

Ohura, Takeshi, et al., Polymer Degradation and Stability, vol. 63, pp. 23-29 (1999).

(Continued)

*Primary Examiner* — Joseph S Del Sole
*Assistant Examiner* — David N Brown, II
(74) *Attorney, Agent, or Firm* — Birch, Stewart, Kolasch & Birch, LLP

(57) ABSTRACT

An object of the present invention is to provide: a process for conveniently producing a fiber with high strength, regardless of molecular weight polymer composition, or the like of PHAs, which vary depending on origins such as a wild-type PHAs-producing microorganism product, a genetically modified strain product, and a chemical product; and the fiber with high strength produced through the process.

The present invention provides: a process for producing a fiber, comprising: melt-extruding polyhydroxyalkanoic acid to form a melt-extruded fiber; rapidly quenching the melt-extruded fiber to the glass transition temperature of polyhydroxyalkanoic acid +15° C. or less, and solidifying the fiber to form an amorphous fiber; forming a crystalline fiber by leaving the amorphous fiber to stand at the glass transition temperature +15° C. or less; drawing the crystalline fiber; and further subjecting the crystalline fiber to stretch heat treatment.

3 Claims, 1 Drawing Sheet

U.S. PATENT DOCUMENTS

| | | | | |
|---|---|---|---|---|
| 6,764,623 | B2 * | 7/2004 | Kim et al. | 264/103 |
| 6,797,225 | B2 * | 9/2004 | Takagi et al. | 264/466 |
| 6,867,248 | B1 * | 3/2005 | Martin et al. | 523/124 |
| 7,199,212 | B2 * | 4/2007 | Nakajima et al. | 528/282 |
| 2008/0147034 | A1 * | 6/2008 | Wang et al. | 604/370 |
| 2008/0287026 | A1 * | 11/2008 | Chakravarty et al. | 442/414 |

FOREIGN PATENT DOCUMENTS

| | | | |
|---|---|---|---|
| GB | 1101766 | | 1/1968 |
| JP | 7-300720 | A | 11/1995 |
| JP | 8-218216 | A | 8/1996 |
| JP | 10-176070 | | 6/1998 |
| JP | 2000027030 | A | 1/2000 |
| JP | 2000154425 | A | 6/2000 |
| JP | 2000-192370 | A | 7/2000 |
| JP | 2003-328230 | | 11/2003 |
| JP | 2003-328231 | A | 11/2003 |
| WO | WO-03/072857 | A1 | 9/2003 |

OTHER PUBLICATIONS

Yamamoto, T. et al., Intern. Polymer Processing, vol. XII, pp. 29-37 (1997).

* cited by examiner

[Figure 1]
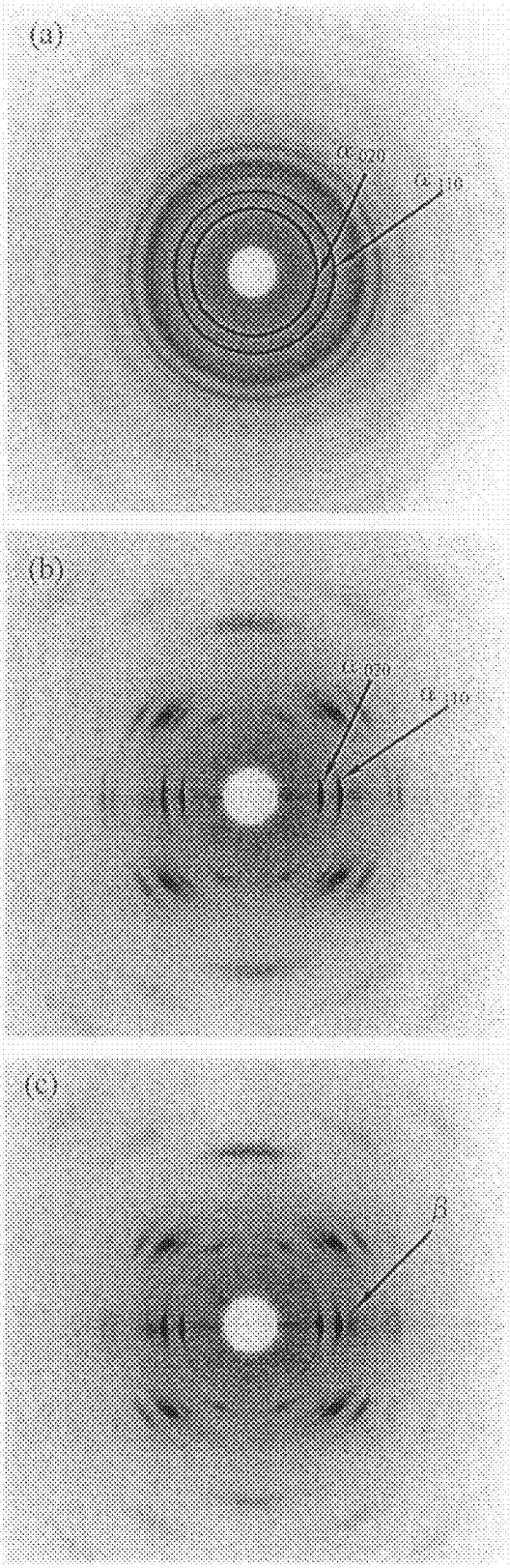

HIGH-STRENGTH FIBER OF BIODEGRADABLE ALIPHATIC POLYESTER AND PROCESS FOR PRODUCING THE SAME

TECHNICAL FIELD

The present invention relates to a fiber produced from polyhydroxyalkanoic acids (hereinafter, also referred to as "PHAs") as a raw material and a process for producing the same. More specifically, the present invention relates to a high-strength fiber of polyhydroxyalkanoic acids and a process for producing the same.

BACKGROUND ART

PHAs are biodegradable and biocompatible, and their use for various molded products such as fibers or films has been studied. A great demand for a fiber produced from PHAs as a raw material can be anticipated as: medical equipment such as surgical sutures; fishery equipment such as fishing lines and fishing nets; clothing materials such as fibers; construction materials such as nonwoven fabrics and ropes; packaging materials for food or the like; etc.

PHAs, such as poly(3-hydroxybutyric acid) (hereinafter, also referred to as "P(3HB)"), are synthesized as intracellular reserve substances in many microorganisms found in nature. Such P(3HB) obtained by P(3HB)-producing microorganisms has been expected as raw materials for biodegradable products.

However, P(3HB) biosynthesized from a wild-type P(3HB)-producing microorganism has a number average molecular weight (Mn) of about 300,000 (i.e., a weight average molecular weight (Mw) of about 600,000). Such low-molecular-weight P(3HB) is rigid and fragile, so the fiberization thereof has been difficult.

In contrast, the present inventors have biosynthesized ultrahigh-molecular-weight P(3HB) of Mn=1,500,000 (Mw=3,000,000) from a recombinant *Escherichia coli* and have succeeded in convenient production of a P(3HB) film having improved physical properties in a reproducible manner (see Patent Document 1).

Further, as a process for fiberization of P(3HB), P(3HB) is melt-extruded, quenched, and solidified to form an amorphous fiber and the amorphous fiber is then cold-drawn almost at its glass transition temperature to orient the molecular chain of the amorphous fiber and subjected to a heat treatment, thereby resulting in success in convenient production of a P(3HB) fiber in a well reproducible manner. Further, in such a process, the use of ultrahigh-molecular-weight P(3HB) has lead to success in production of a fiber having improved physical properties, or a high-strength fiber (see Patent Document 2). Further, the use of ultrahigh-molecular-weight P(3HB) for performing further drawing after cold-drawing has lead to success in production of high-strength fibers with a high degree of elasticity (see Patent Document 3).

However, in those processes, there is a problem in that the fibers could not be provided with sufficiently high strength with respect to low-molecular-weight P(3HB). Therefore, a single-stage drawing is insufficient for obtaining a sufficient strength, so two or more stages of drawing should be carried out. However, the low-molecular-weight P(3HB) biosynthesized by the wild-type P(3HB)-producing microorganism is rigid and fragile, so it cannot be subjected to such a processing. Therefore, a process for obtaining high-strength fibers has been demanded regardless of the molecular weights of PHAs, which vary depending on origins such as a wild-type PHAs-producing microorganism product, a genetically modified strain product, and a chemical product.

Further, any of those processes require two- or more-staged drawing for obtaining sufficient strength, so the versatility thereof has been insufficient because of a large number of steps involved. Therefore, a process for more convenient production of a high-strength fiber has been demanded.

In contrast, processes for improving the physical properties of P(3HB) fibers by copolymerization of P(3HB) have been well studied. The copolymers of PHAs have been known to show a variety of physical properties by changing the types and compositions of monomers. Among them, poly[(R)-3-hydroxybutyric acid-co-(R)-3-hydroxyvaleric acid] (hereinafter, also referred to as "[P(3HB-co-3HV)]") is commercially available as Biopol (registered trademark from Monsanto Co., Ltd.), having a tensile strength of 183 MPa, an elongation to break of 7%, and a Young's modulus of 9.00 GPa (see Non Patent Document 1). A fiber with a tensile strength of 210 MPa and an elongation to break of 30%, and a Young's modulus of 1.80 GPa has been reported as a fiber obtained from P(3HB-co-8%-3HV) by a process for simultaneously carrying out drawing and heat treatment, through the use of a continuous drawing machine after melt-extraction (see Non Patent Document 2). However, for using a copolymer fiber as a practical material, the copolymer fiber has been demanded to be further strengthened.

Non-patent Document 1: T. Ohura, Y. Aoyagi, K. Takagi, Y. Yoshida, K. Kasuya, Y. Doi, Polym. Degrad. Stab., 63, 23-29 (1999)

Non-patent Document 2: T. Yamamoto, M. Kimizu, T. Kikutani, Y. Furuhashi, M. Cakmak, Int. Polym. Processing, XII, 29-37 (1997)

Patent Document 1: JP 10-176070 A

Patent Document 2: JP 2003-328230 A

Patent Document 3: JP 2003-328231 A

DISCLOSURE OF THE INVENTION

Problem to be Solved by the Invention

An object of the present invention is to provide: a process for conveniently producing a fiber with high strength, regardless of molecular weight polymer composition, or the like of PHAs, which vary depending on origins such as a wild-type PHAs-producing microorganism product, a genetically modified strain product, and a chemical product; and the fiber with high strength produced through the process.

Means for Solving the Problems

As a result of intensive studies, the present inventors have completed the present invention by finding out that the above-mentioned problems can be solved by preparing a melt-extruded fiber by melt-extrusion of polyhydroxyalkanoic acid, solidifying the melt-extruded fiber by rapid-quenching it to the glass transition temperature of polyhydroxyalkanoic acid +15° C. or less, to form an amorphous fiber, leaving the amorphous fiber to stand at the glass transition temperature +15° C. or less to form a crystalline fiber, drawing the crystalline fiber, and subjecting it to a stretch heat treatment.

The gist of the present invention is as follows:

(1) A process for producing a fiber, comprising:

melt-extruding polyhydroxyalkanoic acid to form a melt-extruded fiber;

rapidly quenching the melt-extruded fiber to the glass transition temperature of polyhydroxyalkanoic acid +15° C. or less, and solidifying the fiber to form an amorphous fiber;

forming a crystalline fiber by leaving the amorphous fiber to stand at the glass transition temperature +15° C. or less;

drawing the crystalline fiber; and further subjecting the crystalline fiber to stretch heat treatment.

(2) The process for producing a fiber according to claim 1, wherein the polyhydroxyalkanoic acid is a poly(3-hydroxybutyric acid)homopolymer or a poly(3-hydroxybutyric acid) copolymer.

(3) A fiber of polyhydroxyalkanoic acid, which is produced by the process for producing a fiber according to claim 1 and having a tensile strength of 300 MPa or more.

BRIEF DESCRIPTION OF DRAWINGS

FIG. 1 shows X-ray diffraction patterns (photographs) of P(3HB-co-8%-3HV) fibers.

FIG. 1(*a*) is an X-ray diffraction pattern of a fiber fixed on a drawing device (at a draw ratio of 100%) and only subjected to a heat treatment at 60° C. for 30 minutes after fiber spinning.

FIG. 1(*b*) is a X-ray diffraction pattern of a fiber subjected to a heat treatment at 60° C. for 30 minutes after drawing at a draw ratio of 5 times at room temperature directly after fiber spinning.

FIG. 1(C) is a X-ray diffraction pattern of a fiber subjected to a heat treatment at 60° C. for 30 minutes after drawing at a draw ratio of 5 times at room temperature after isothermal crystallization for 24 hours almost at a glass transition temperature (0° C.) after fiber spinning.

DESCRIPTION OF SYMBOLS

| | |
|---|---|
| α110 | diffraction due to α structure at (110) |
| α020 | diffraction due to α structure at (020) |
| β | β structure |

BEST MODE FOR CARRYING OUT THE INVENTION

Hereinafter, the embodiments of the present invention will be described.

(1) Process for Producing a Fiber of the Present Invention (i) PHAs Used in the Present Invention In the production process of the present invention, PHAs are used as fiber-forming materials. Preferable monomers of polyhydroxyalkanoic acids include 3-hydroxybutyric acid, 4-hydroxybutyric acid, 3-hydroxyvaleric acid, 3-hydroxyhexanoic acid, and 6-hydroxyhexanoic acid.

The PHAs used in the present invention may be a homo polymer composed of one selected from those hydroxyalkanoic acids, or alternatively a copolymer composed of two or more selected from those hydroxyalkanoic acids. Preferable homo polymers include P(3HB). Preferable copolymers include copolymers of 3-hydroxybutyric acid with other alkanoic acids, such as poly(3-hydroxybutyric acid-co-3-hydroxyvaleric acid), poly(3-hydroxybutyric acid-co-3-hydroxyhexanoic acid), poly(3-hydroxybutyric acid-co-6-hydroxyhexanoic acid), and poly(3-hydroxybutyric acid-co-4-hydroxybutyric acid.

In general, processes for synthesizing PHAs include fermentation synthesis and chemical synthesis. The chemical synthesis is a process for chemically synthesizing PHAs according to a process of general organic synthesis. Specifically, for example, the chemical synthesis can synthesize PHA by ring-opening polymerization of fatty acid lactones, such as (R)-β-butyrolactone and ε-caprolactone, in the presence of a catalyst (Abe et al., Macromolecules, 28, 7630 (1995)). In addition, for instance, it can be synthesized by ring-opening polymerization of δ-valerolactone in the presence of a catalyst (Furuhasi et al., J. Polym. Sci. Part B, Polym. Phys (2001) 39, 2622).

In contrast, fermentation synthesis is a process for culturing a microorganism capable of producing PHAs and extracting PHAs accumulated in the microbial cells. A microorganism that can be used for fermentation synthesis is not particularly limited as long as it is a microorganism capable of producing PHAs. Sixty (60) or more species of wild-type microorganisms, which include the genus *Ralstonia*, such as *Ralstonia eutropha*, and the genus *Alcaligenes*, such as *Alcaligenes latus* and *Alcaligenes faecalis* are known as a microorganism capable of producing polyhydroxybutyric acid (hereinafter, also referred to as "PHB"). Those microorganisms accumulate PHBs in their bodies. In addition, known microorganisms that produce copolymers of hydroxybutyric acids with other hydroxyalkanoic acids include *Aeromonas caviae*, which is a microorganism that produces both poly(3-hydroxybutyric acid-co-3-hydroxyvaleric acid) and poly(3-hydroxybutyric acid-co-3-hydroxyhexanoic acid), and *Ralstonia eutropha*, which is a microorganism that produces poly(3-hydroxybutyric acid-co-4-hydroxybutyric acid).

In the fermentation synthesis, the microorganisms are generally cultured in a usual medium containing a carbon source, a nitrogen source, inorganic ions, and if necessary, other organic components, to thereby accumulate PHB in the cells. PHB can be collected from the microbial cells through processes including extraction with an organic solvent such as chloroform, or degradation of the microbial components with an enzyme such as lysozyme followed by collecting PHB granules by filtration.

Further, a mode of the fermentation synthesis includes a process for culturing a microorganism which is transformed by introduction of a recombinant DNA containing a PHB synthesis gene, and collecting PHB produced in the microbial cells. This process differs from culturing of PHB-producing microorganisms such as *Ralstonia eutropha* as it is, in that a transformant has no PHB depolymerase in its cell, and thus, PHB having remarkably high molecular weight can be accumulated.

As such a transformed strain, for example, JP 10-176070 A discloses transformant *Escherichia coli* XL1-Blue (pSYL105) obtained by introducing plasmid pSYL105 containing a PHB synthesis gene phbCAB of *Ralstonia eutropha* into *Escherichia coli* XL1-Blue. Further, the transformant *Escherichia coli* XL1-Blue (pSYL105) is available from Stratagene Cloning Systems, Inc. (11011 North Torrey Pines Road, La Jolla, Calif. 92037, USA).

A transformant is cultured in an appropriate medium, and therefore PHB can be accumulated in the cells. A medium used includes a general medium containing a carbon source, a nitrogen source, inorganic ions, and if necessary, other organic components. When *Escherichia coli* is used, glucose or the like is used as a carbon source, and yeast extract, tryptone, or the like derived from natural substances is used as a nitrogen source. In addition, the medium may contain an inorganic nitrogen compound or the like such as an ammonium salt. The culture is preferably carried out under aerobic conditions for 12 to 20 hours, at a culture temperature of 30 to 37° C., and at pH of 6.0 to 8.0. PHB can be collected from the microbial cells through processes including extraction with an organic solvent such as chloroform, or degradation of the microbial components with an enzyme such as lysozyme followed by collecting PHB granules by filtration. To be specific, PHB can be extracted from dried microbial cells, which are separated and collected from a culture solution, with an appropriate poor solvent followed by precipitating using a precipitant.

In addition, the PHAs used in the present invention may be ones commercially available, such as P(3HB) and P(3HB-co-3HV) from Monsanto Co., Ltd.

The molecular weights of the PHAs used in the present invention may be generally Mn=100,000 (Mw=200,000) or more, preferably Mn=300,000 (Mw=600,000) or more, but not particularly limited as long as they do not affect on the effects of the present invention. The upper limit of the molecular weight is not particularly limited.

For the PHAs used in the present invention, granules containing PHAs may be employed without purification or polymers purified therefrom through a purification process described below or the like may be employed.

(ii) Production Process of the Present Invention

In the process of the present invention, a fiber is produced by: melt-extruding the above-described PHAs to form a melt-extruding fiber; solidifying the melt-extruding fiber by quenching it to the glass transition temperature of PHAs +15° C. or less to form an amorphous fiber; leaving the amorphous fiber to stand for the glass transition temperature +15° C. or less to form a crystalline fiber, drawing the crystalline fiber, and subjecting the fiber to stretch heat treatment.

Hereinafter, the process of the present invention will be described for each step.

(First Step)

A melt-extruded fiber is formed by melt-extrusion of PHAs.

A process for melt-extrusion of PHAs can be carried out by using general melting techniques for plastic fibers, for example, by heating and melting PHAs and imposing loads thereon to extrude from an extrusion orifice.

The melt-extrusion is generally carried out at temperature equal to the melting point of PHA to be melted or more, preferably the melting point +10° C. or more, more preferably the melting point +15 to 20° C. or more. In the case of PHB, the melting point thereof is 170° C. or more. In the case of the copolymer, the melting point varies depending on its composition, and for example 140° C. or more for P(3HB-co-3HV).

(Second Step)

A melt-extruded fiber is rapid quenched to the glass transition temperature of PHA +15° C. or less and solidified to form an amorphous fiber. The rapid quenching and the solidification are carried out generally at the glass transition temperature +15° C. or less, preferably at the glass transition temperature +10° C. or less, more preferably at the glass transition temperature or less. In addition, a lower limit is, but not particularly limited to, generally −180° C. or more from economical viewpoints. The molten PHAs form into amorphous fibers through the quenching step.

The glass transition temperature can be evaluated through dynamic viscoelasticity measurement, for example. Dynamic viscoelasticity can be measured by, for example, using DMS210 manufactured by Seiko Instruments & Electronics Ltd. in a range of −100 to 120° C. under the conditions of nitrogen atmosphere, a frequency of 1 Hz, and a temperature increase rate of 2° C./min. A low-molecular-weight PHB with Mn=about 300,000 has a glass transition temperature of 4° C. or less. In the case of the copolymer, the glass transition temperature varies depending on its composition, and for example −4° C. or less for P(3HB-co-3HV). It should be noted that higher glass transition temperature is useful for easy processing.

Examples of the cooling medium include air, water (ice water), and an inert gas. In the present invention, the quenching may be carried out by, for example, extruding the molten PHAs into a solvent such as air or ice water at its glass transition temperature +15° C. or less and allowing the molten PHAs to pass through the solvent while winding. A wind rate is 3 to 150 m/min, preferably 3 to 30 m/min.

An amorphous fiber can be confirmed through processes such as X-ray diffraction, for example. When no peak assigned to crystals is detected in X-ray diffraction, the fiber is amorphous.

(Third Step)

The crystalline fiber is formed by leaving an amorphous fiber to stand at its glass transition temperature +15° C. or less.

In general, the crystallization can be carried out at the glass transition temperature +15° C. or less, preferably the glass transition temperature +10° C. or less, more preferably the glass transition temperature or less. For the temperature of the crystallization, a lower limit is, but not particularly limited to, generally −180° C. or more from economical viewpoints.

The time period for crystallization is generally about 6 to 72 hours, preferably about 12 to 48 hours. According to the isothermal crystallization at the glass transition temperature +15° C. or less, the crystallization of fiber proceeds very slowly. In addition, the resulting crystal is very small. Such a small crystal may perform as a basic point of drawing (drawing nucleus) and a molecular chain is highly oriented by a first-stage drawing (drawing at a comparatively low draw ratio). In the fiber of the present invention, it can be speculated from the fact that part of the molecular chain has become a fully-stretched structure (β structure) even in the case of a draw ratio of 5 times (see FIG. 1). If the time period for crystallization is too short, the crystallization cannot proceed sufficiently. Therefore, it is not preferable because of insufficient crystallization. In contrast, if the time period for crystallization is too long, the crystallization proceeds too much. Therefore, it is not preferable because of a decrease in processability.

(Fourth Step)

The crystalline fiber is drawn.

The drawing can be carried out at the glass transition temperature or more, for example at room temperature. In general, the temperature for the drawing can be carried out at the melting point or less, but the upper limit of the temperature is not particularly limited.

The drawing may be carried out under tension by, for example, fixing a fiber onto a drawing machine or the like and winding using two wind-up rollers. When a fiber is fixed onto a drawing machine or the like, a draw ratio is generally 200% or more, preferably 500% or more. An upper limit for the draw ratio is not particularly limited, and only needs to be smaller than a ratio causing breaking of a fiber.

(Fifth Step)

After the drawing, the fiber is further subjected to stretch heat treatment.

The stretch heat treatment may include warm air heat treatment and drier heat treatment. The stretch heat treatment may be carried out generally at about 25 to 150° C., preferably at about 40 to 100° C. for about 5 seconds to 120 minutes in general, preferably for about 10 seconds to 30 minutes.

In the stretch heat treatment, stretch may be applied by fixing, loading, or under tension, for example. Fixing heat treatment refers to heat treatment of a fiber with its both ends fixed. When a fiber is loaded with a weight hung from one end thereof in heat treatment, the load is preferably as heavy as possible as long as the fiber does not break. The load can be determined within a range smaller than a load causing breaking of a drawn fiber. Further, heat treatment can be performed using a wind-up roller or the like while applying tension by varying feed and wind rates of the rollers. The fiber is subjected to heat treatment while being drawn under tension. A fiber can be subjected to heat treatment under tension using a wind-up roller to a draw ratio of generally 100% or more, preferably 300% or more. A draw ratio of 100% refers to winding so that the fiber does not stretch. An upper limit for the draw ratio is not particularly limited, and only needs to be smaller than a ratio not causing breaking of a fiber.

Heretofore, even though high-strength fibers has been obtained using high-molecular-weight PHBs with Mn=1,500,000 (Mw=3,000,000) or more as a raw material, fibers produced from low-molecular-weight PHAs with Mn=about 300,000 (Mw=about 600,000) as a raw material have not been provided with physical properties comparable to those of the general polymer fiber. However, according to the process of the present invention, the drawing can be performed in one stage and drawing at high draw ratio is not necessary, so it becomes possible to prepare a high-strength fiber even from a low-molecular-weight PHA. In other words, according to the present invention, it becomes possible to conveniently obtain a high-strength fiber regardless of the molecular weight of PHB, the composition of the polymer, and so on.

(2) Fiber of the Present Invention

The fiber of the present invention is those prepared by forming a melt-extruded fiber by melt-extrusion of PHAs, rapidly quenching the melt-extruded fiber to the glass transition temperature of the PHAs +15° C. or less to solidify to form an amorphous fiber, leaving the amorphous fiber to stand at the glass transition temperature +15° C. or less to form a crystalline fiber, drawing the crystalline fiber, and subjecting the fiber to stretch heat treatment. A preferable mode of the fiber includes a fiber of polyhydroxyalkanoic acid produced through the above-described process and having tensile strength of 300 MPa or more.

The term "tensile strength" used herein refers to a value measured in accordance with JIS-K-6301. The fiber of the present invention has a tensile strength of 300 MPa or more, preferably 500 MPa or more.

The fiber of the present invention is an oriented crystalline fiber in which the orientation of a crystalline portion of the PHAs fiber is in one direction. In the conventional production process, a high-strength fiber can be obtained when high-molecular-weight PHB of Mn=1,500,000 (Mw=3,000,000) or more is employed as a raw material. In contrast, the fibers produced from low-molecular-weight PHAs as a raw material of Mn=about 300,000 (Mw=600,000) through a conventional production process hardly had physical properties sufficiently comparable to those of the general polymer fibers. However, the present invention can provide an oriented crystalline fiber having physical properties sufficiently comparable to those of the general polymer fibers regardless of the molecular weight and polymer composition of PHAs.

Examples of materials that may be used for fiber formation according to the present invention include various additives generally used for forming a fiber such as a lubricant, an ultraviolet absorbing agent, a weathering agent, an antistatic agent, an antioxidant, a heat stabilizer, a nucleus agent, a fluidity-improving agent, and a colorant, in addition to the above-described PHAs.

The fiber of the present invention has sufficient strength as described above and is made of PHAs which are excellent in biodegradability and biocompatibility. Thus, the fiber of the present invention is useful for: medical equipment such as surgical sutures; fishery equipment such as fishing lines and fishing nets; clothing materials such as fibers; construction materials such as nonwoven fabrics and ropes; packaging materials for food or the like; etc.

EXAMPLES

Hereinafter, the present invention will be described in more detail with examples, but the present invention is not limited to the examples as long as it is within the scope of the invention.

Examples 1 to 7, Control Example 1, Comparative Examples 1 to 2

Preparation of Polymer

P(3HB) granules manufactured by Monsato Co., Ltd. were dissolved in chloroform and filtered, and then re-precipitated into hexane, thereby obtaining purified P(3HB). The molecular weight of the P(3HB) was Mn=250,000, Mw=720,000, and the polydispersity thereof was Mw/Mn=2.9. The melting point and glass transition point of P(3HB) were 173° C. and 0° C., respectively.

(Preparation of Fibers of Examples)

A P(3HB) sample was packed into a core column of 5 mm in inner diameter and 120 mm in length in an extrusion device and then retained at melting temperature (180 to 185° C.) for a given period of time. After completely melting the sample, the extrusion was initiated. A nozzle used for extrusion orifice was 1 mm.

The melt-extruded fiber was wound in ice water, thereby obtaining an amorphous fiber. The amorphous fiber was left standing in ice water for 24 to 72 hours to carry out isothermal crystallization, thereby preparing a crystalline fiber. Subsequently, by using a hand-turned drawing machine, the fiber was drawn at a draw ratio shown in Table 1, followed by subjecting the fiber to thermal treatment under constant tension at 60° C. for 30 minutes (at a draw ratio of 100%), thereby preparing a fiber.

(Preparation of Fiber of Control Example)

A crystalline fiber was prepared in a manner similar to the process for producing the fibers of Examples described above. The crystalline fiber was fixed on the drawing machine (at a draw ratio of 100%), and then subjected to thermal treatment under constant tension at 60° C. for 30 minutes, thereby preparing a fiber.

(Preparation of Fibers of Comparative Examples)

An amorphous fiber was prepared in a manner similar to the process for producing the fibers of Examples described above. The amorphous fiber was immediately drawn by using a drawing machine at room temperature to a draw ratio shown in Table 1. Subsequently, the fiber was subjected to thermal treatment under constant tension at 60° C. for 30 minutes, thereby preparing a fiber.

The resultant fibers were subjected to measurements of tensile strength, elongation to break, and Young's modulus. The results are shown in Table 1. The tensile strength, elongation to break, and Young's modulus were measured using a small-sized desktop tester, EZ Test, manufactured by Shimadzu Corporation on the basis of JIS-K-6301. A tensile rate was set to 20 mm/min.

TABLE 1

Fiber physical properties of poly[(R)-3-hydroxybutyric acid]

| | Time period for crystallization (hr) | Draw ratio (%) | Tensile strength (MPa) | Elongation to break (%) | Young's modulus (MPa) |
|---|---|---|---|---|---|
| Control Example 1 | 24 | 100 | 26 | 5 | 1.32 |
| Example 1 | 24 | 500 | 650 | 27 | 7.53 |
| Example 2 | 25 | 300 | 470 | 45 | 5.76 |
| Example 3 | 40 | 300 | 685 | 39 | 8.35 |
| Example 4 | 72 | 300 | 570 | 42 | 5.18 |
| Example 5 | 25 | 400 | 390 | 44 | 5.20 |
| Example 6 | 40 | 400 | 441 | 33 | 7.22 |
| Example 7 | 72 | 400 | 740 | 26 | 10.7 |
| Comparative Example 1 | 0 | 100 | 27 | 10 | 1.17 |
| Comparative Example 2 | 0 | 500 | 92 | 52 | 2.12 |

The results show that the physical properties of the fibers improve through the process of the present invention.

Examples 8 to 11, Control Examples 2 to 3, Comparative Examples 3 to 8

Preparation of Polymer

P(3HB-co-8%-3HV) and P(3HB-co-12%-3HV) granules manufactured by Monsato Co., Ltd. were respectively dissolved in chloroform and filtered, and then re-precipitated into hexane, thereby obtaining purified P(3HB-co-3HV). The 3HV percentage of the P(3HB-co-8%-3HV) was 7.7%, Mn was 360,000, Mw was 1,000,000, and the polydispersity thereof Mw/Mn was 2.8. The melting point and glass transition point of P(3HB-co-8%-3HV) were 173° C. and −4° C., respectively. The 3HV percentage of the P(3HB-co-12%-3HV) was 10.8%, Mn was 190,000, Mw was 490,000, and the polydispersity thereof Mw/Mn was 2.5. The melting point and glass transition point of P(3HB-co-12%-3HV) were 136° C. and −5.1° C., respectively.

(Preparation of Fibers of Examples)

A P(3HB-co-3HV) sample was packed into a core column of 5 mm in inner diameter and 120 mm in length in an extrusion device and then retained at melting temperature (170° C. for P(3HB-co-8%-3HV) and 165° C. for P(3HB-co-12%-3HV)) for a given period of time. After completely melting the sample, the extrusion was initiated. A nozzle used for extrusion orifice was 1 mm.

The melt-extruded fiber was wound in ice water, thereby obtaining an amorphous fiber. The amorphous fiber was left standing in ice water for 24 to 48 hours to carry out isothermal crystallization, thereby preparing a crystalline fiber. Subsequently, by using a hand-turned drawing machine, the fiber was drawn at draw ratios shown in Tables 2 and 3, followed by subjecting the fiber to thermal treatment under constant tension at 60° C. for 30 minutes (at a draw ratio of 100%), thereby preparing a fiber.

(Preparation of Fiber of Control Example)

A crystalline fiber was prepared in a manner similar to the process for producing the fibers of Examples described above. The crystalline fiber was fixed on the drawing machine (at a draw ratio of 100%), and then subjected to thermal treatment under constant tension at 60° C. for 30 minutes, thereby preparing a fiber.

(Preparation of Fibers of Comparative Examples)

An amorphous fiber was prepared in a manner similar to the process for producing the fibers of Examples described above. The amorphous fiber was immediately drawn by using a drawing machine at room temperature to draw ratios shown in Tables 2 and 3. Subsequently, the fiber was subjected to thermal treatment under constant tension at 60° C. for 30 minutes, thereby preparing a fiber.

The obtained fibers were measured for tensile strength, elongation to break, and Young's modulus. Tables 2 and 3 show the results.

TABLE 2

Fiber physical properties of poly[(R)-3-hydroxybutyric acid-co-8%-(R)-3-hydroxyvaleric acid]

| | Time period for crystallization (hr) | Draw ratio (%) | Tensile strength (MPa) | Elongation to break (%) | Young's modulus (GPa) |
|---|---|---|---|---|---|
| Control Example 2 | 24 | 100 | 27 | 15 | 1.18 |
| Example 8 | 24 | 500 | 709 | 50 | 6.81 |
| Example 9 | 24 | 1000 | 1322 | 31 | 8.11 |
| Comparative Example 3 | 0 | 100 | 28 | 13 | 1.07 |
| Comparative Example 4 | 0 | 500 | 167 | 67 | 2.82 |
| Comparative Example 5 | 0 | 1000 | 371 | 36 | 4.54 |

TABLE 3

Fiber physical properties of poly[(R)-3-hydroxybutyric acid-co-12%-(R)-3-hydroxyvaleric acid]

| | Time period for crystallization (hr) | Draw ratio (%) | Tensile strength (MPa) | Elongation to break (%) | Young's modulus (GPa) |
|---|---|---|---|---|---|
| Control Example 3 | 48 | 100 | 25 | 10 | 0.81 |
| Example 10 | 48 | 500 | 353 | 42 | 2.24 |
| Example 11 | 48 | 1000 | 694 | 30 | 4.97 |
| Comparative Example 6 | 0 | 100 | 32 | 11 | 0.82 |
| Comparative Example 7 | 0 | 500 | 40 | 88 | 0.95 |
| Comparative Example 8 | 0 | 1000 | 233 | 80 | 1.50 |

The results show that the physical properties of the fibers improve through the process of the present invention.

(Structural Analysis of Fibers of Examples and Comparative Examples)

The structural analysis of fibers obtained in Example 8 and Comparative Examples 3 and 4 was performed by analyzing their X-ray diffraction patterns, respectively.

The X-ray diffraction was carried out using a RIGAKU RINT Ultra X18 X-ray diffraction device. Fibers were aligned in one direction and X-rays were then radiated perpendicular to the drawing direction, thereby taking an X-ray picture of the fiber. X-rays generated at a voltage of 40 kV and an electric current of 200 mA were made monochromatic with a Ni filter and a Cu—Kα rays ($\lambda$=0.1542 nm) obtained through a collimeter of 0.3 mmϕ was then irradiated onto the sample. Recording was carried out using a plate camera filled with an imaging plate with a camera length of 40 mm and an irradiation time of 2 hours.

Results are shown in FIG. 1. FIGS. 1(*a*) to 1(*c*) are X-ray diffraction patterns for the fiber fixed on the drawing device (at a draw ratio of 100%) after fiber spinning and then subjected to only a heat treatment at 60° C. for 30 minutes (Comparative Example 3), the fiber drawn at a draw ratio of 5 times at room temperature right after fiber spinning and then subjected to a heat treatment at 60° C. for 30 minutes (Comparative Example 4), and the fiber drawn at a draw ratio of 5 times at room temperature after isothermal crystallization for 24 hours at approximately a glass transition temperature (0° C.) after fiber spinning and then subjected to a heat treatment at 60° C. for 30 minutes. In FIG. 1(*b*), diffractions due to the α structures at (020) and (110) are observed (portions indicated by the respective arrows), but no diffraction due to the β structure is observed. In FIG. 1(*c*), diffraction due to the β structure is observed (portion indicated by the arrow).

As is evident from the results, the fiber of Example 8 has the β structure formed therein even by the drawing at a small draw ratio. It is considered that the expression of the β structure contributed to an increase in strength of the fiber. In contrast, the fibers of Comparative Examples 3 and 4 did not have any β structure formed therein.

INDUSTRIAL APPLICABILITY

The present invention can provide a process for producing a fiber with high strength, and the fiber with high strength produced through the process, regardless of molecular weights of PHAs varying depending on origins, such as a wild-type PHAs-producing microorganism product, a genetically modified strain product, and a chemical product.

The invention claimed is:

1. A process for producing a fiber, comprising:

melt-extruding polyhydroxyalkanoic acid to form a melt-extruded fiber;

rapidly quenching the melt-extruded fiber to the glass transition temperature of polyhydroxyalkanoic acid +15° C. or less, and solidifying the fiber to form an amorphous fiber;

forming a crystalline fiber by leaving the amorphous fiber to stand at the glass transition temperature +15° C. or less for 24 to 72 hours;

drawing the crystalline fiber; and further subjecting the crystalline fiber to stretch heat treatment.

2. The process for producing a fiber according to claim 1, wherein the polyhydroxyalkanoic acid is a poly (3-hydroxybutyric acid) homopolymer or a poly (3-hydroxybutyric acid) copolymer.

3. A fiber of polyhydroxyalkanoic acid, which is produced by the process for producing a fiber according to claim 1.

* * * * *